United States Patent [19]

Holder

[11] 4,165,019

[45] Aug. 21, 1979

[54] TANK FOR FLUIDS UNDER PRESSURE

[76] Inventor: Philippe Holder, Marnaz (Haute Savoie), France

[21] Appl. No.: 890,220

[22] Filed: Mar. 27, 1978

Related U.S. Application Data

[63] Continuation-in-part of Ser. No. 719,521, Sep. 1, 1976, abandoned.

[30] Foreign Application Priority Data

Sep. 2, 1975 [FR] France ..... 75 26934

[51] Int. Cl.[2] ..... B65D 41/04

[52] U.S. Cl. ..... 220/288; 220/3

[58] Field of Search ..... 220/31, 288, 304; 156/69, 175, 417, 419

[56] References Cited

U.S. PATENT DOCUMENTS

| | | | |
|---|---|---|---|
| 3,398,852 | 8/1968 | Katz | 220/288 |
| 3,843,010 | 10/1974 | Morse et al. | 220/3 |

*Primary Examiner*—George T. Hall

*Attorney, Agent, or Firm*—John T. Roberts

[57] ABSTRACT

The invention provides a tank for fluids under pressure, wherein there is a cylindrical body open at both ends and covered with a winding, the bottoms of said tank consisting of caps entering partly and without any clearance the ends of the cylinder, said caps carrying a pad applying onto the ends of the cylinder, a stay-rod located inside the cylinder being made directly integral with both caps through its two ends, a particular use of said tank being connected to an inflatable balloon for use in rescuing skiers.

5 Claims, 6 Drawing Figures

Figure: 1
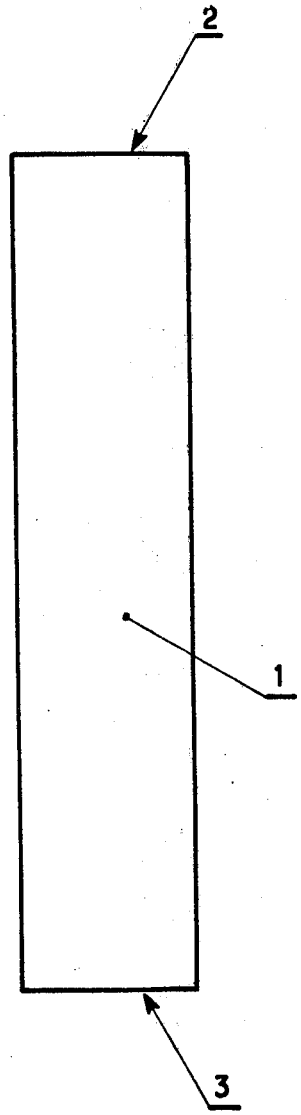
Figure: 2
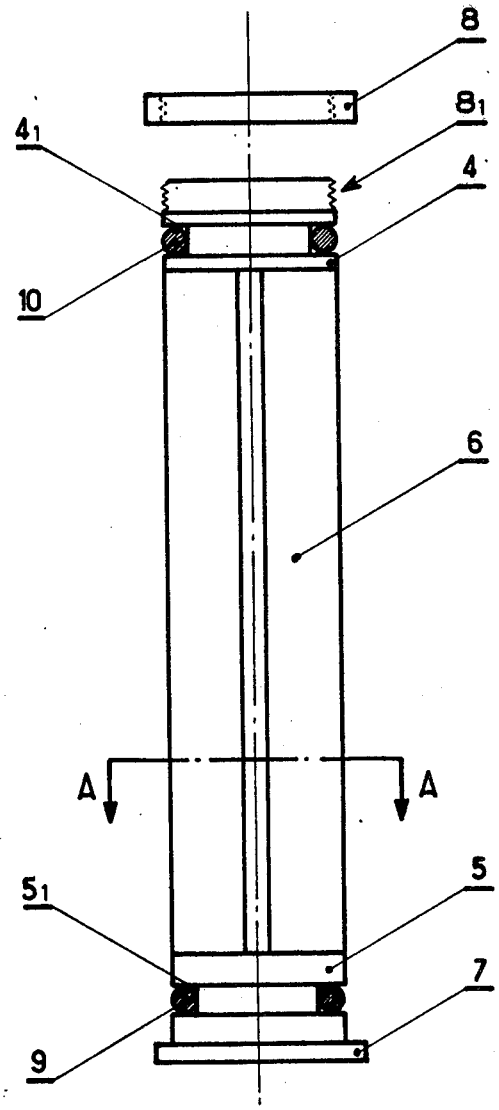
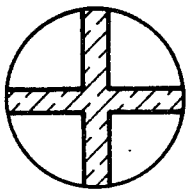
Figure: 3

TANK FOR FLUIDS UNDER PRESSURE

CROSS-REFERENCE TO RELATED APPLICATION

This invention is a continuation-in-part of my application entitled "A TANK FOR FLUIDS UNDER PRESSURE," Ser. No. 719,521, filed on Sept. 1, 1976, now abandoned, the priority of which is claimed for the common subject matter.

The present invention provides a tank for fluids under pressure for the various purposes including inflating balloons which aid in locating injured skiers.

Tanks for fluids under pressure are already known and used, in particular for aeronautic and astronautic purposes, which are made of fibers and specifically of carbon fibers, resulting in very light tanks with resistance to high pressures.

However, these tanks entirely made (including the bottom) of one piece through fibrous winding, have the drawbacks of being very expensive because manufacturing takes a long time, is delicate, requires specific winding machines for each type of tank to be built, and involves a great quantity of material due to the fact that the winding must be done according to a special crossing of the carbon threads so as to simultaneously reach the ends of the tank.

The following U.S. patents are illustrative of the pior art:

Griscom, U.S. Pat. No. 179,300
Sweetser, U.S. Pat. No. 636,083
Kidwell, U.S. Pat. No. 945,099
Ragatettli, U.S. Pat. No. 3,367,815
Wiltshire, U.S. Pat. No. 3,449,182

One purpose of the present invention is to remedy these drawbacks and provide a tank for fluids under pressure wherein there is a cylindrical body open at both ends and covered with a winding, the end of said tank consisting of caps entering partly and without any clearance the ends of the cylinder, said caps having a pad applied to the ends of the cylinder, and a stay-rod located inside the cylinder being made directly integral with both caps through its two ends.

A variation of the invention is that one or both of the caps is directly secured through screwing to one of the ends of the stay-rod.

The use for which the tank is intended fulfills another purpose of the invention, which is to provide a means for rescuing skiers caught in an avalanche. Heretofore no satisfactory way has been found to locate skiers overtaken by avalanches and buried under the snow. It is an object of the present invention to provide such a means.

The tank is used to inflate a balloon which is attached to the skier by a string and can be easily spotted by rescuers. Thus it is an object of the present invention to provide a tank which is small, light and inexpensive enough to be used by skiers and at the same time strong enough to be used to inflate the rescue balloon.

The present invention is represented by way of non-limitative example in the attached drawings, wherein:

FIG. 1 shows the body of the tank.

FIG. 2 is a side view of the device constituting the top, bottom, and stay-rod, but not the body, of the tank.

FIG. 3 is a cross-section view according to A—A of FIG. 2.

Figure 4:
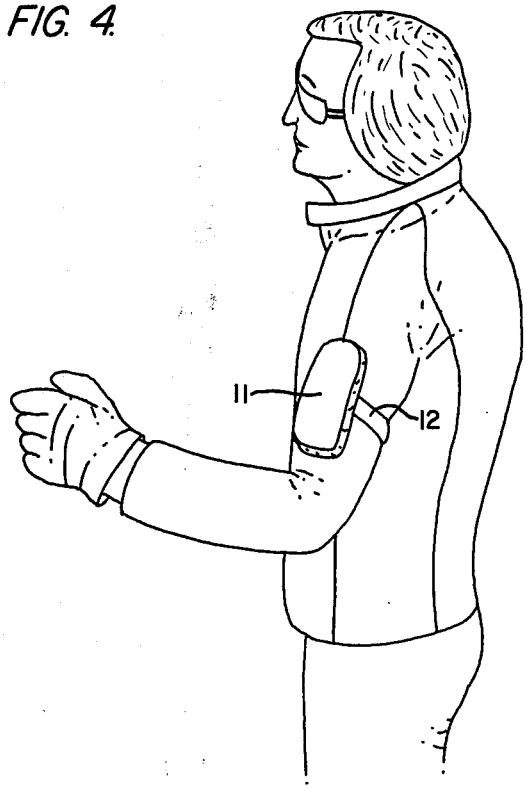
FIG. 4 shows the case containing the tank and deflated balloon as it is carried by the skier.

The tank consists of a cylindrical body 1, achieved through a fibrous winding and, in particular, through winding of carbon threads, said threads being preferably permeated with a resin which afterwards constitutes the coating of the cylinder, said resin being obviously selected so as to be compatible with the fluid to be introduced into the tank.

Possibly, the wound cylinder can be associated with a metallic cylinder, made of aluminum for example, located inside the cylinder made of wound thread and aimed to facilitate winding and to improve the tightness of the tank.

Both ends 2 and 3 of said cylinder are open, which makes it possible to fabricate each portion of cylinder for a tank by simply cutting a long tube into pieces. This can be done simultaneously with operation of the winding-machine, such mode of production further reducing the cost of the tank.

Both ends 2 and 3 of the cylinder 1 are sealed by means of added pieces 4 and 5 which, in the example shown, are integral with the stay-rod 6 which connects them together.

The stay-rod is essentially designed to support the pull generated on the surfaces of the caps inside the cylinder. Such a solution then solves the problems resulting from the great shearing forces which would be generated by a cap inside an excessively thin wall of the body.

The caps 4 and 5 are designed to be introduced inside the ends 2 and 3 of the cylinder 1 and, thereby, have a diameter corresponding to the internal diameter of the cylinder.

However, the ends of said caps carry pads 7 and 8, designed to be applied and tightened against the ends 2 and 3 and, in the example shown in the figure, the pad 8 is removable through screwing at $8_1$ onto the body of the cap 4, so that the assembly caps 4, 5 and stay-rod 6 might be introduced inside the cylinder 1. Afterwards it is possible to tighten the pads 7 and 8 on the ends 3 and 2 by screwing the pad 8 on the portion of the threading $8_1$ which protrudes from the end 2 of the cylinder.

On each cap 4, 5, circular grooves $4_1$ and $5_1$ are provided, designed to receive a sealing gasket or joint, preferably strand-shaped joint, 9, 10, which apply against the internal wall of the cylinder 1 so as to ensure the tightness of the tank, said tightness being possibly completed by sticking the caps on the internal wall of the cylinder.

As shown in FIGS. 2 and 3, the stay-rod is integral with the caps 4 and 5. It is, however, to be understood that said stay-rod can constitute a piece remote from the caps and made integral with the latter by any connecting means, such as screws, rivets, pins and the like. Said stay-rod, if cross-piece-shaped, may have a width substantially corresponding to the internal diameter of the cylinder 1, thus permitting increased resistance to crushing when the tank is empty.

Also, it is to be noted that the stay-rod makes it possible to increase the resistance of the tank to twist, said twist likely to be exerted between both caps.

Of course, this tank carries filling and draining valves known in themselves, and which will preferably be secured on the caps.

The tank is used to inflate balloons which aid in locating skiers who are injured or caught in an avalanche.

FIG. 4 shows the packet 11 containing the tank, the balloon and the string fastened to the arm of the skier by means of a strap 12. Due to its small size and light weight, it could obviously be carried conveniently in other ways as well.

When a skier hears an avalanche, he can rapidly release the valve on the tank, which instantly inflates the balloon. The balloon is connected to the skier by means of a long cord or string. While the snow from the avalanche hits the skier and buries him, the balloon rests always on the surface of the snow due to its light weight and the fluid qualities of the snow. The balloon and skier remain connected by the string.

Figure 5:
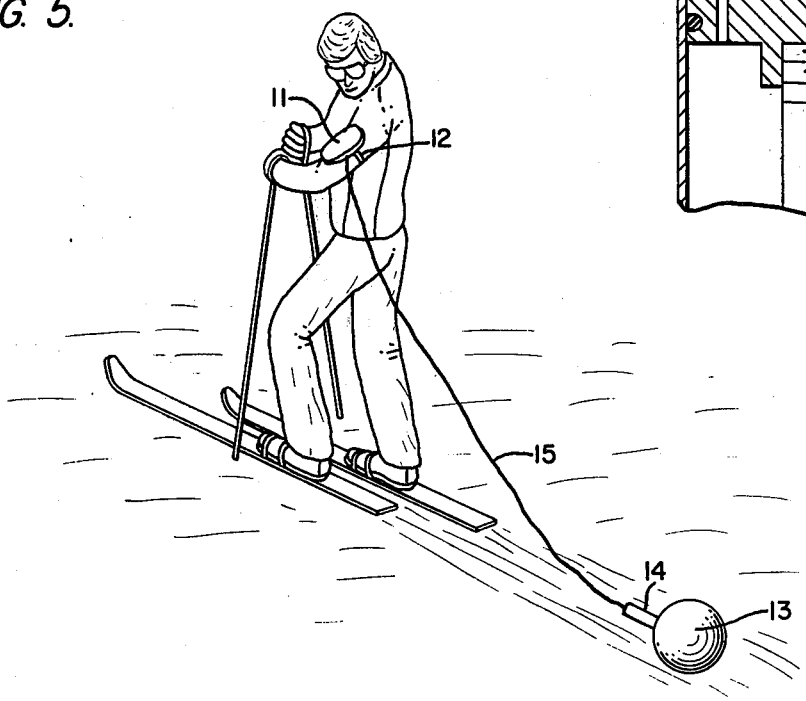
FIG. 5 shows the inflated balloon connected to the tank and attached to the skier by a cord.

FIG. 5 shows the inflated balloon 13, to which the tank 14 remains attached, connected to the skier by the cord 15.

It would be possible to vary this arrangement and have the tank remain with the skier. This would require that the balloon have an automatic sealing means of some sort.

Figure 6:
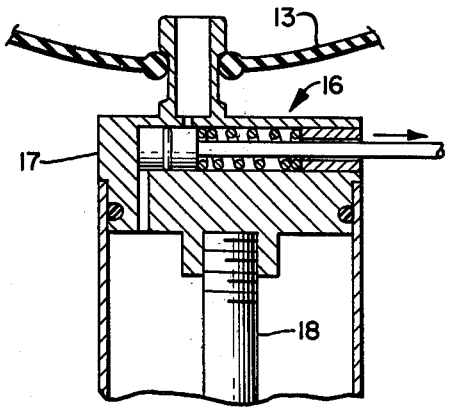
FIG. 6 shows a later version of the tank in which the valve attached to the balloon in cross-section is unreleased state.

FIG. 6 shows the head of the tank attached to the balloon 13. The valve arrangement 16 is shown schematically and any suitable valve may be used. This drawing is illustrative of how the invention functions. When the valve is released by the skier the gas inflates the balloon. Also illustrated is an integral end piece 17 and a cylindrical stay rod 18 which is simply screwed into the end piece.

The balloon resting on the snow's surface can be easily spotted by rescue parties. They then follow the string to the skier, who would be very difficult to find without this device.

Of course, the invention is not limited to the examples of embodiment described and depicted hereabove, from which other modes and forms of embodiment can be provided without thereby departing from the scope of the invention.

I claim:

1. A tank for storage of fluids under pressure comprising in combination, (a) a cylindrical body open at both ends, (b) said cylindrical body covered with a fibrous winding around the periphery thereof, (c) two caps having a diameter equal to the interior diameter of the cylinder, (d) said caps spaced apart the distance of the length of the cylinder and held in position by a stay rod integral with both caps, (e) two pads having a diameter at least equal to the outside diameter of said cylinder.

(f) said pads attached in axial alignment to the outer side of said caps.

2. The combination of claim 1 in which one pad is integrally attached to one cap and the other cap has a first portion of a diameter at least as small as said second cap and attached integrally and axially to the outer side thereof, said portion having an external thread, a second portion of said second pad, having an internal thread cooperating with said external thread is comprised of two circular portions, one portion being annular in shape with internal threads and the other having a diameter smaller than that of the annular portion with external circumferential threads which cooperate with internal threads on the inner circumference of the annular portion to attach the two portions both integrally and axially.

3. The combination of claim 1 which includes uniform grooves around the periphery of each cap where in engages the cylinder and deformable means within said grooves to ensure a fluid tight fit between said cylinder and said cap.

4. The combination of claim 1 in which the stay rod is cross shaped, the width of a side of the cross piece corresponding to the internal diameter of the cylinder.

5. The use of a tank according to claim 1 to inflate a balloon for the purpose of locating skiers.

* * * * *